US009851175B2

(12) United States Patent
Leasure

(10) Patent No.: US 9,851,175 B2
(45) Date of Patent: Dec. 26, 2017

(54) FULLY ADJUSTABLE GUNSTOCK WITH INTEGRATED TOOL HOLDER

(71) Applicant: Hunting Tactical, LLC, Scottsville, NY (US)

(72) Inventor: Stephen T. Leasure, Scottsville, NY (US)

(73) Assignee: Hunting Tactical, LLC, Scottsville, NY (US)

( * ) Notice: Subject to any disclaimer, the term of this patent is extended or adjusted under 35 U.S.C. 154(b) by 0 days.

(21) Appl. No.: 15/098,814

(22) Filed: Apr. 14, 2016

(65) Prior Publication Data

US 2016/0313087 A1 Oct. 27, 2016

Related U.S. Application Data

(60) Provisional application No. 62/179,001, filed on Apr. 27, 2015.

(51) Int. Cl.

| | |
|---|---|
| ***F41C 23/00*** | (2006.01) |
| ***F41C 23/16*** | (2006.01) |
| ***F41A 11/00*** | (2006.01) |
| *F41C 23/20* | (2006.01) |
| *F41C 23/22* | (2006.01) |
| *F41C 23/10* | (2006.01) |

(52) U.S. Cl.

CPC ..... *F41C 23/16* (2013.01); *F41A 11/00* (2013.01); *F41C 23/10* (2013.01); *F41C 23/20* (2013.01); *F41C 23/22* (2013.01)

(58) Field of Classification Search

CPC ..... F41C 23/16; F41C 23/14; F41C 23/22; F41C 27/00

USPC ..... 42/71.01, 72, 73

See application file for complete search history.

(56) References Cited

U.S. PATENT DOCUMENTS

| | | | |
|---|---|---|---|
| 28,433 | A | 5/1860 | Alsop |
| 181,289 | A | 8/1876 | Sherman |
| 190,033 | A | 4/1877 | Hartley |
| 555,602 | A | 3/1896 | Foulkrod |
| 562,487 | A | 6/1896 | Quackenbush |
| 729,030 | A | 5/1903 | Yount |
| 855,229 | A | 5/1907 | Clarisey |
| 959,069 | A | 5/1910 | Powers |
| 1,248,029 | A | 11/1917 | Snedecor et al. |

(Continued)

FOREIGN PATENT DOCUMENTS

| | | | |
|---|---|---|---|
| EP | 1748272 | A2 | 1/2007 |
| WO | 2014078462 | A1 | 5/2014 |

*Primary Examiner* — Samir Abdosh

(74) *Attorney, Agent, or Firm* — Timothy W. Menasco, Esq.; Harter Secrest & Emery LLP

(57) ABSTRACT

Presented are a firearm attachment and a method. An exemplary firearm attachment includes a gunstock comprising a cavity for attachment to a barrel, a handgrip port including a mount, a buttstock port, and a magazine port, the magazine port located on the gunstock to align with a magazine, the mount operable to slideably move and be affixed along a longitudinal axis of the gunstock. The firearm attachment further includes a handgrip, the handgrip removeably attached to the mount, the handgrip able to rotate relative to the gunstock to a plurality of locations, wherein the handgrip can be rotatably fixed at each one of the plurality of locations. The firearm attachment also includes a buttstock and a forearm grip.

15 Claims, 6 Drawing Sheets

(56) References Cited

U.S. PATENT DOCUMENTS 2,400,349 A * 5/1946 Haberstump ..... F41C 23/04 42/72
2,405,758 A * 8/1946 Sampson ..... F41C 23/04 42/72
2,669,051 A 2/1954 Cline
2,763,951 A * 9/1956 Harvey ..... F41C 23/22 42/71.01
2,766,542 A * 10/1956 Harvey ..... F41C 23/22 42/71.01
3,306,168 A * 2/1967 Blumrick ..... F41A 3/38 42/75.02
3,369,316 A * 2/1968 Miller ..... F41C 23/04 42/72
3,618,248 A * 11/1971 Into ..... F41C 23/22 42/71.01
4,122,623 A 10/1978 Stice
4,630,387 A 12/1986 Crane et al.
4,689,908 A * 9/1987 McClellan ..... F41C 23/10 224/198
4,757,627 A * 7/1988 Saligari ..... A22B 3/02 42/1.12
4,788,785 A * 12/1988 White ..... F41C 23/04 42/72
4,884,354 A 12/1989 Senfter
5,048,213 A * 9/1991 Gerhard ..... F41C 23/22 42/71.01
5,970,642 A 10/1999 Martin
6,560,911 B2 5/2003 Sharp
6,662,485 B2 12/2003 Kay
6,839,998 B1 * 1/2005 Armstrong ..... F41C 23/00 42/71.01
7,181,881 B2 * 2/2007 Fischbach ..... F41A 15/00 42/71.01
7,243,454 B1 * 7/2007 Cahill ..... F41C 23/12 42/72
7,337,573 B1 * 3/2008 DiGiovanna ..... F41C 23/04 42/71.01
D604,794 S 11/2009 Bentley
7,637,049 B1 * 12/2009 Samson ..... F41A 35/00 42/107
8,752,323 B2 * 6/2014 Fulton ..... F41C 23/14 42/73
8,984,794 B1 * 3/2015 Saur ..... F41C 27/00 42/108
9,115,955 B2 * 8/2015 Barnhart ..... F41C 23/16
9,234,717 B2 * 1/2016 Jarboe ..... F41A 21/485
2006/0010746 A1 * 1/2006 Little ..... F41A 19/09 42/69.01
2006/0242880 A1 * 11/2006 Griffin ..... F41C 23/04 42/73
2008/0052978 A1 * 3/2008 Cahill ..... F41C 23/12 42/90
2009/0288324 A1 * 11/2009 Peterson ..... F41A 11/02 42/75.03
2011/0283588 A1 * 11/2011 Samson ..... F41A 35/00 42/108
2013/0125442 A1 * 5/2013 Burress, Jr. ..... F41C 23/16 42/71.01
2015/0247695 A1 * 9/2015 Jarboe ..... F41A 21/485 42/71.01

* cited by examiner

FULLY ADJUSTABLE GUNSTOCK WITH INTEGRATED TOOL HOLDER

BACKGROUND OF THE DISCLOSURE

Field of the Disclosure

The present disclosure relates to a method and apparatus for an adjustable firearm. The present disclosure relates more specifically to a method and apparatus for a gunstock attachment, which includes multiple adjustable features.

Description of Related Art

A stock or gunstock is generally a part of a rifle or other firearm, to which the barrel and firing mechanism are attached. The stock provides a means for the shooter to firmly support the firearm and easily aim it. The stock also transmits recoil from firing the firearm into the shooter's body.

The most basic breakdown of stock types is into one-piece and two-piece stocks. A one piece stock is a single unit from butt to fore-end, such as that commonly found on bolt action rifles. Two piece stocks use a separate piece for the butt and fore-end, such as that commonly found on break open shotguns, lever-action rifles and shotguns. Traditionally two piece stocks were easier to make, since finding a wood blank suitable for a long one piece stock is harder than finding short blanks for a two piece stock.

The grip area is one that varies widely. A straight grip stock proceeds smoothly from toe to the trigger, giving a nearly horizontal angle for the trigger hand, while a full grip stock contains a separate piece for the grip, providing a near vertical angle for the trigger hand, and is commonly found on modern military rifles, such as the AK-47 and M16 rifle families. A semi-grip stock is the most common sport stock, with a steeper angle cut into the stock to provide a more diagonal angle for the trigger hand. Modern target style stocks have moved towards a fuller, more vertical grip, though built into the stock rather than made as a separate piece, and may be considered grip stocks. Other stocks use a nearly vertical grip, and many thumbhole style stocks are similar to full grips in shape.

Sliding or folding stocks are often seen on military-grade weapons and their civilian-derived arms. A collapsible stock makes the weapon more compact for storage or transport, but is usually deployed before shooting for better control. A butt hook, which is an attachment to the butt of the gun that is put under the shooter's arm to prevent the rifle from pivoting forward from the weight of the barrel is sometimes used in competitive rifle shooting. These stocks are also used on combat shotguns.

SUMMARY OF THE DISCLOSURE

In view of the foregoing, it is an object of the present disclosure to provide a method and apparatus for adjustment.

A first exemplary embodiment of the present disclosure provides a firearm attachment for adjustment including a gunstock comprising a cavity for attachment to a barrel, a handgrip port including a mount, a buttstock port, and a magazine port, the magazine port located on the gunstock to align with a magazine, the mount operable to slideably move and be affixed along a longitudinal axis of the gunstock, and a handgrip, the handgrip removeably attached to the mount, the handgrip able to rotate relative to the gunstock to a plurality of locations, wherein the handgrip can be rotatably fixed at each one of the plurality of locations. The firearm attachment further includes a buttstock, the buttstock removeably attached to the buttstock port, the buttstock able to rotate relative to the gunstock to a plurality of locations, wherein the buttstock can be rotatably fixed at each one of the locations, and a forearm grip, the forearm grip removeably attached to the gunstock, the forearm grip operable to slide to a plurality of locations relative to the gunstock, wherein the forearm grip can be affixed at each one of the locations.

A second exemplary embodiment of the present disclosure provides a method including providing a gunstock comprising a cavity for attachment to a barrel, a handgrip port including a mount, a buttstock port, and a magazine port, the magazine port located on the gunstock to align with a magazine, the mount operable to slideably move and be affixed along a longitudinal axis of the gunstock, and affixing a handgrip to the gunstock at the mount, the handgrip removeably attached to the mount, the handgrip able to rotate relative to the gunstock to a plurality of locations, wherein the handgrip can be rotatably fixed at each one of the plurality of locations. The method further includes affixing a buttstock to the gunstock at the buttstock port, the buttstock removeably attached to the buttstock port, the buttstock able to rotate relative to the gunstock to a plurality of locations, wherein the buttstock can be rotatably fixed at each one of the locations, and affixing a forearm grip at the forearm grip port, the forearm grip removeably attached to the gunstock, the forearm grip operable to slide to a plurality of locations relative to the gunstock, wherein the forearm grip can be affixed at each one of the locations.

A third exemplary embodiments of the present disclosure provides an apparatus for attachment. The apparatus includes a gunstock comprising a cavity for maintaining a receiver, the gunstock including a mount, the mount operable to slideably be affixed along the longitudinal axis of the gunstock, and a handgrip removeably attached to the mount, the handgrip operable to rotatably affix to a plurality of locations relative to the gunstock.

A fourth exemplary embodiment of the present disclosure provides a method for attachment. The method includes providing a gunstock comprising a cavity for maintaining a receiver, the gunstock including a mount, the mount operable to slideably be affixed along the longitudinal axis of the gunstock. The method further includes providing a handgrip removeably attached to the mount, the handgrip operable to rotatably affix to a plurality of locations relative to the gunstock.

The following will describe embodiments of the present disclosure, but it should be appreciated that the present disclosure is not limited to the described embodiments and various modifications of the disclosure are possible without departing from the basic principle. The scope of the present disclosure is therefore to be determined solely by the appended claims.

BRIEF DESCRIPTION OF THE SEVERAL VIEWS OF THE DRAWING(S)

DETAILED DESCRIPTION OF THE DISCLOSURE

A gunstock (also known as stock or shoulder stock) is the component of a firearm that is attached to the barrel of the firearm and interfaces with the user (i.e., shooter). A stock is also found on crossbows though a crossbow stock is more properly referred to as a tiller. The stock provides a means for the shooter to firmly support the device and easily aim it. The stock also transmits recoil into the user's body. The size and configuration of the gunstock is related to the safe and comfortable operation of the firearm. Accuracy of the firearm is also greatly impacted by the interface of the gunstock and the user.

For the purposes of this disclosure, rifle refers to any firearm or weapon that through the use of an explosion, spring or compressed gas emits a projectile from a barrel. This includes but is not limited to a rifle, shotgun, BB gun, pellet gun, blow, and the like. Buttstock or simply butt refers to the part of a rifle or other firearm, to which the barrel and firing mechanism are attached. During use, the butt stock is typically held against the user's shoulder.

A cheek rest is the portion of the gunstock that interfaces with the user's cheek when aiming the firearm. Proper positioning of the cheek rest allows the user to align their eye in a stable and comfortable alignment with the sighting means of the firearm. The forearm (also known as handguard, forend, or forestock) is a section of the firearm between the receiver and the muzzle and positioned below the barrel. It is used to hold the firearm steady.

A handgrip is that portion of the firearm and/or stock that is held by the hand that operates the trigger and orients the hand in a forward, vertical orientation, similar to the position one would take with a conventional pistol.

Embodiments of the present disclosure provide an adjustable gunstock that adjusts to fit the shooter in multiple dimensions quickly and easily through the use of one or more tools. These adjustments provide improved accuracy of the firearm through an improved user interface with the buttstock, forearm, cheek rest, and handgrip. All adjustments provide a firearm that fits a large range of arm length and hand sizes. Embodiments of the adjustable gunstock provides improved firearm control to the user. The adjustable gunstock can be adjusted through the use of one or more simple hand tools that can be maintained within the gunstock. Embodiments of the adjustable gunstock with the simple hand tool allows the firearm user to perform field adjustments. Embodiments further allow a user to carry a single tool rather than multiple tools for adjustment.

Embodiments also provide an adjustable gunstock that can be adjusted at one or more adjustment points (e.g., handgrip, buttstock, forearm grip) to the fit the user in multiple dimensions quickly and easily with the use of one or more tools.

Figure 1:
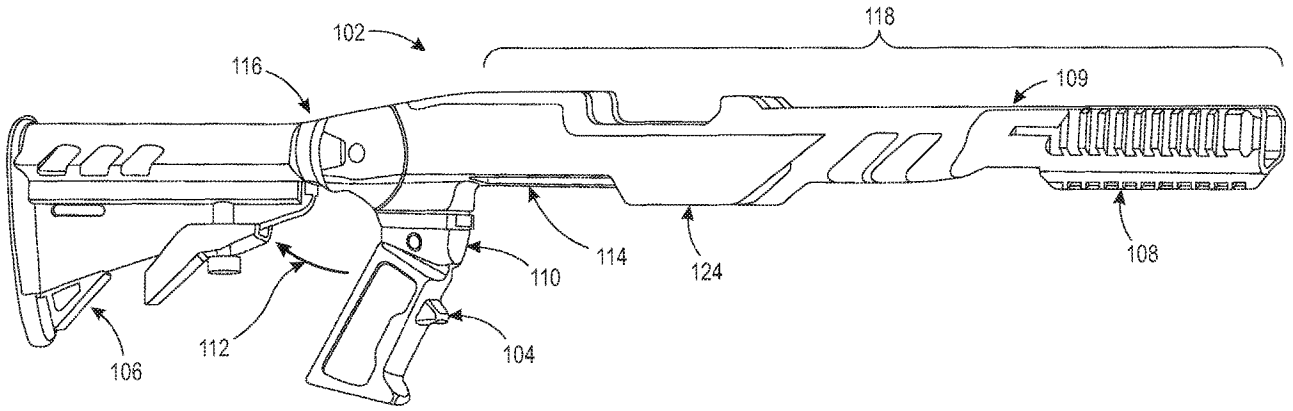
FIG. 1 is a side perspective view of a configuration of a device suitable for use in practicing exemplary embodiments of this disclosure.

Referring to FIG. 1, shown is a side perspective view of a configuration of a device suitable for use in practicing exemplary embodiments of this disclosure. Shown in FIG. 1 is stock (also known as gunstock) 102, handgrip 104, buttstock 106, forearm grip 108, and barrel compartment 109.

Handgrip 104 is removeably attached to stock 102 at mount 110. Handgrip 104 can be removeably affixed to stock 102 at mount 110 through the use of one or a combination of screws, nuts, bolts, clasps, or clamps such that hand grip 104 can be removeably attached to mount 110 and detached from mount 110. Handgrip 104 includes any type of firearm handgrip located below the trigger port 114. In other words, handgrip 104 is located between buttstock 106 and the trigger port 114. Handgrip 104 is further operable to rotate relative to stock 102 such that the rake angle 112 between handgrip 104 and stock 102 can be adjusted from 0 to 90 degrees. A plurality of rake angles 112 can be maintained using one or more screws, nuts, bolts, clamps or comparable engagement structure.

Mount 110 is also moveable relative to stock 102 along the longitudinal axis of stock 102 to either increase or decrease the distance between mount 110 and trigger port 114. One or more like screws, nuts, bolts, clamps, or comparable method of attachment can maintain a location of mount 110. The longitudinal location of mount 110 relative to stock 102 can be affixed to the stock 102 at a plurality of locations through means of a rail, slide, notched interface, jack Screw, Dovetail, and/or other comparable means.

While embodiments of the present disclosure as shown in FIG. 1 include a stock or gunstock with a handgrip, buttstock, and forearm grip, it should be appreciated that embodiments include a gunstock with handgrip, or a gunstock with a handgrip and a buttstock, or a gunstock with a handgrip and a forearm grip.

Buttstock 106 includes an extending member (also known as buffer tube) that is moveable along the longitudinally axis of stock 102 between an extended position and a compressed position to thereby increase or decrease the length of stock 102. Embodiments of buttstock 106 and stock 102 provide an overall length that is adjustable by extending buttstock 106 between approximately 26 inches to 33 inches. However, it should be appreciated that embodiments of buttstock 106 and stock 102 include any length able to accommodate a receiver and operate as described herein. Buttstock 106 is also operable to pivot or rotate relative to the longitudinal axis of stock 102 at pivot point 116 toward handgrip 104 to any angle between approximately 0 to 90 degrees relative to the longitudinal axis of stock 102. Buttstock 106 thus allows the user to alter the height and/or angle of the stock 102 relative to the user. Rotation of buttstock 106 allows a user to position the cheek rest portion of stock 102 to provide an optimal user interface. The cheek rest portion of stock 102 is the part of stock 102 that would contact a user when aiming and firing a firearm maintained within cavity 118 of stock 102. Adjustment of buttstock 106 either by extending or rotating buttstock 106 can be performed both simultaneously and/or independently through means of a rail, slide, notched interface, jack screw, dovetail, and/or other comparable means.

Forearm grip 108 is slideably and removeably attached to stock 102 such that it can operably slide longitudinally along the longitudinal axis of stock 102 in front of trigger location 114. Forearm grip 108 is operably affixed to a plurality of locations along stock 102 through the use of one or more fasteners which may include screws, nuts, bolts, clamps or comparable fastening means.

Barrel compartment 109 defines cavity 118, which is operable for removeably maintaining the barrel of a firearm, such as a rifle. Barrel compartment 109 includes trigger port 114 located adjacent to mount 110. Trigger port 114 provides a passage for a trigger of a firearm to pass through stock 102 such that a user can operate the trigger of the firearm. Trigger port 114 is operably sized to allow the passage of a trigger of a firearm. It should be appreciated that embodiments of stock 102 do not include a trigger port 114 for the case that barrel compartment 109 is sized to accommodate a receiver of a firearm, which would not require a buttstock. Barrel compartment 109 also includes a magazine port 124 located adjacent trigger port 114. Magazine port 124 provides a passage through stock 102 such that a magazine can be removeably attached to a barrel that is maintained by barrel compartment 109.

Embodiments of stock 102 include one of handgrip 104, buttstock 106, and forearm grip 108 having a cavity 120 (not shown) for removeably maintaining removeable tool 122. Removeable tool 122 is operable for adjusting and affixing handgrip 104, buttstock 106 and forearm grip 108 at the plurality of locations/angles relative to stock 102. Removeable tool 122 includes any type of allen wrench, screwdriver, wrench, or other tool operable for interacting or manipulating screws, nuts, bolts, clamps or other fastening means employed by stock 102 for moveably affixing a location of handgrip 104, buttstock 106, or forearm grip 108. Removeable tool 122 can be maintained within cavity 120 by the use of clasps, clamps, holders, or the like. Embodiments of stock 102 include handgrip 104, buttstock 106 and forearm grip 108 being moveably and removeably affixed to stock 102 through the same mechanism whether it be one of screws, nuts, bolts, or clamps. Accordingly, embodiments of removeable tool 122 is operable for removing and affixing each one of handgrip 104, buttstock 106, and forearm grip 108.

Figure 2:
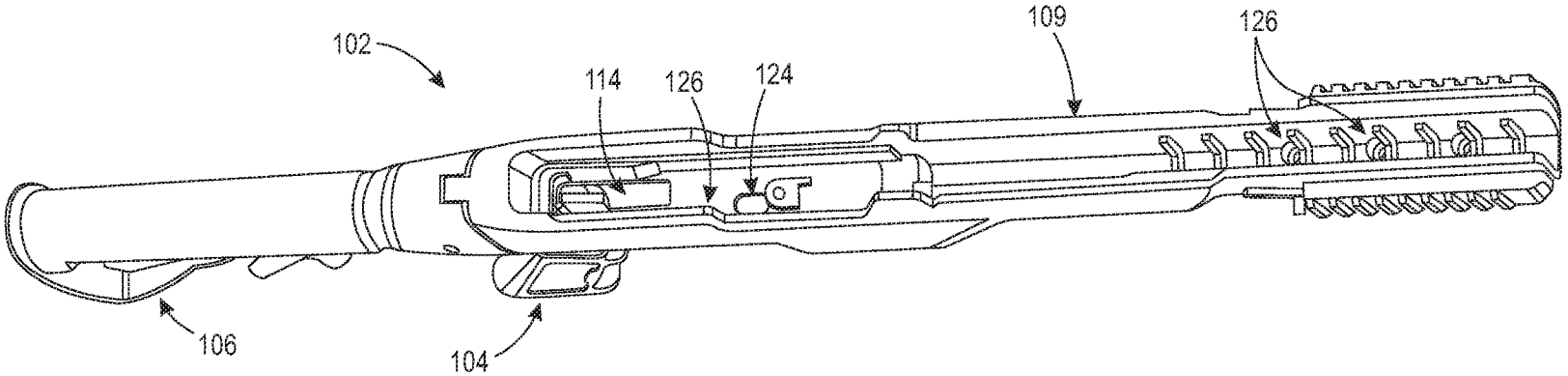
FIG. 2 is a top perspective view of a configuration of a device suitable for use in practicing exemplary embodiments of this disclosure.

Referring to FIG. 2, shown is a top perspective view of a configuration of a device suitable for use in practicing exemplary embodiments of this disclosure. Depicted in FIG. 2 is stock 102, handgrip 104, buttstock 106, barrel compartment 109, trigger port 114, and magazine port 124. As shown in FIG. 2, barrel compartment 109 provides a hollow cavity 118 that has a tubular shape sized to contact the outside surface of a barrel of a firearm. Barrel compartment 109 includes screws, nuts, or bolts 126 for removeably affixing a barrel of a firearm to barrel compartment 109. Embodiments of barrel compartment 109 provide screws, nuts, or bolts 126 at a plurality of locations along the longitudinal axis of barrel compartment 109 operable to removeably affix a barrel of a multiple types of firearms to stock 102.

As is evident from FIG. 2, trigger port 114 provides a hollow passage through stock 102 to barrel compartment 109. Magazine port 124 also provides a hollow passage through stock 102 to barrel compartment 109. Embodiments of trigger port 114 and magazine port 124 include any size or shape such that trigger port 114 and magazine port 124 are operable to different types of triggers and magazines.

Figure 3:
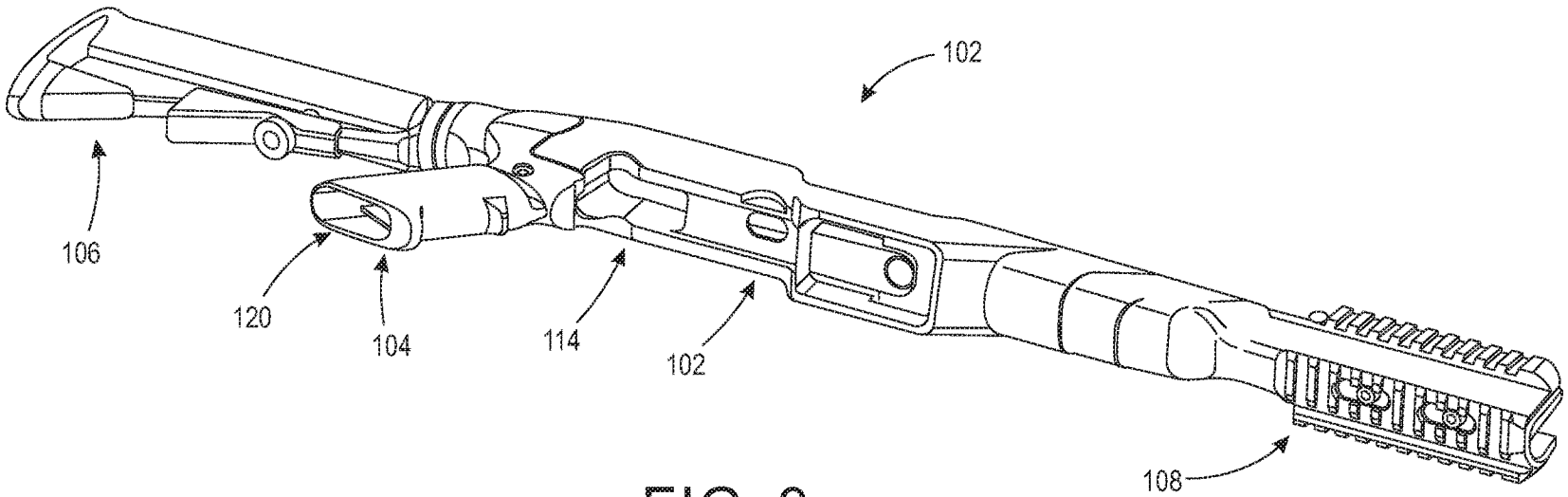
FIG. 3 is a bottom perspective view of a configuration of a device suitable for use in practicing exemplary embodiments of this disclosure.

Reference is now made to FIG. 3, which depicts a bottom perspective view of a configuration of a device suitable for use in practicing exemplary embodiments of this disclosure. Shown in FIG. 3 is stock 102, handgrip 104, buttstock 106, forearm grip 108, trigger port 114, and magazine port 124. Forearm grip 108, as depicted in FIG. 3, is located at the front end of stock 102. However, it should be appreciated that forearm grip 108 is operable to slide and be affixed anywhere along the longitudinal axis of stock 102 between the front end of stock 102 and magazine port 124.

Also shown in FIG. 3 is cavity 120 located within handgrip 104. Cavity 120 includes removeable tool 122 for moveably affixing a location of handgrip 104, buttstock 106, and forearm grip 108 relative to stock 102. Removeable tool 122 is removeably maintained within cavity 120 such that a user can affix removeable tool 122 within cavity 120 and remove removeable tool 122 from cavity 120 when desired. Removeable tool 122 is operably maintained within cavity 120 such that use of stock 102 including handgrip 104 is not obstructed or interfered with by removeable tool 122.

Figure 4:
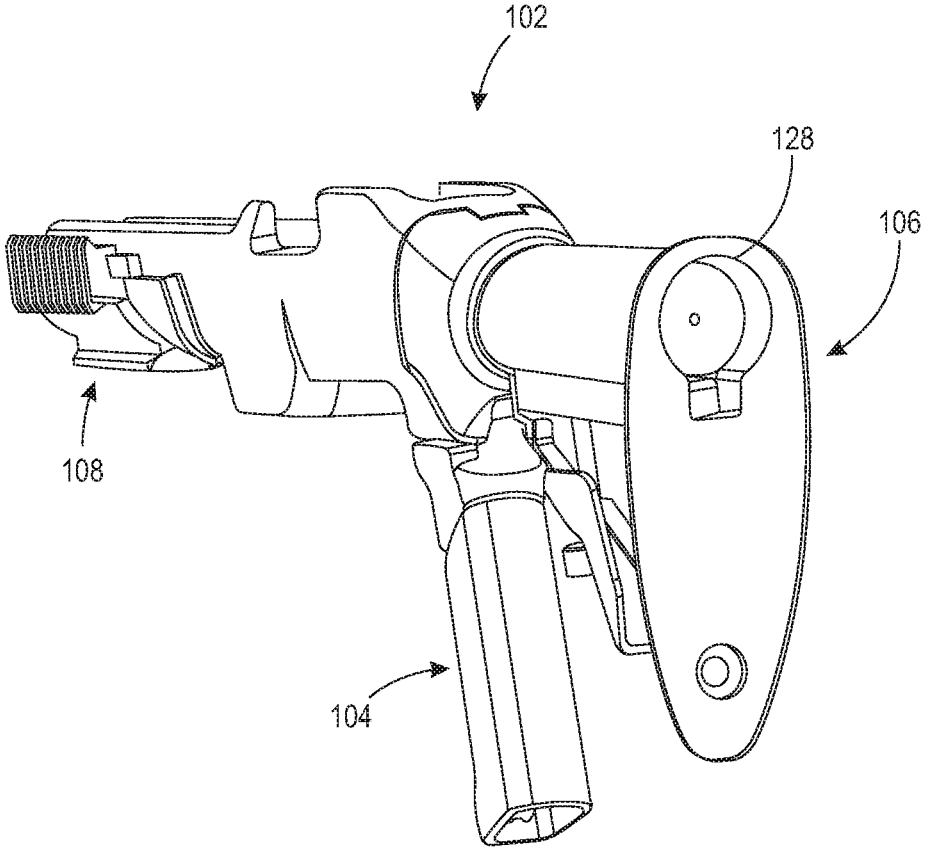
FIG. 4 is a rear perspective view of a configuration of a device suitable for use in practicing exemplary embodiments of this disclosure.

Referring to FIG. 4, shown is a rear perspective view of a configuration of a device suitable for use in practicing exemplary embodiments of this disclosure. Shown in FIG. 4 is stock 102, handgrip 104, buttstock 106, and forearm grip 108. As illustrated in FIG. 4, buttstock 106 includes an extending member (or buffer tube) 128 that allows buttstock to move from a compressed position to an extended position. Thus, embodiments of extending member 128 allow a user to selectively extend the overall length of stock 102. It should be appreciated that embodiments of extending member 128 include any type of tube or slide that allows buttstock 106 to move longitudinally along the long axis of stock 102 relative to stock 102.

Figure 5:
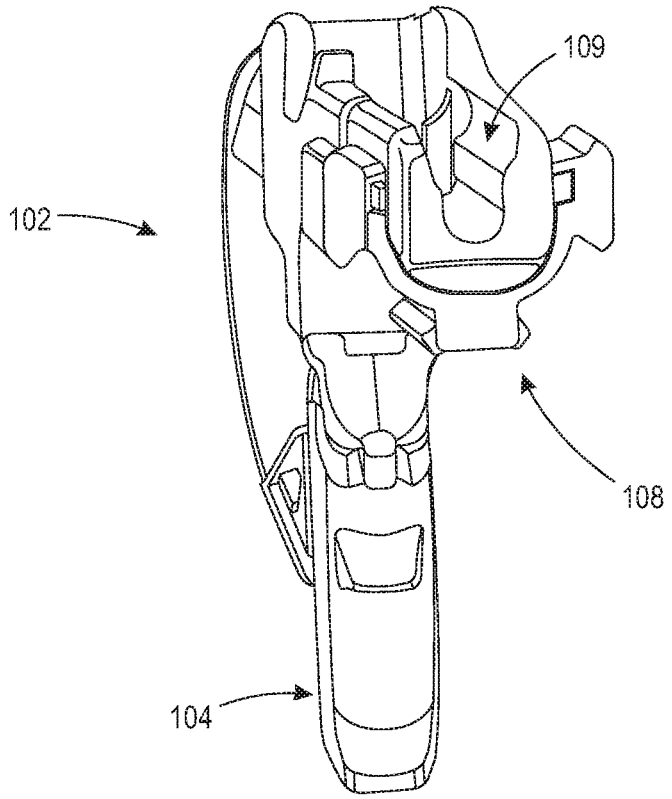
FIG. 5 is a front perspective view of a configuration of a device suitable for use in practicing exemplary embodiments of this disclosure.

Referring to FIG. 5, shown is a front perspective view of a configuration of a device suitable for use in practicing exemplary embodiments of this disclosure. Illustrated in FIG. 5 is stock 102, handgrip 104, forearm grip 108 and barrel compartment 109. As is evident from FIG. 5, barrel compartment 109 extends through the longitudinal axis of stock 102 providing a cavity 118 that has a tubular shape. However, it should be appreciated that embodiments of the barrel compartment 109 include any shape that is sized to fit the long axis of a barrel of a firearm.

Figure 6:
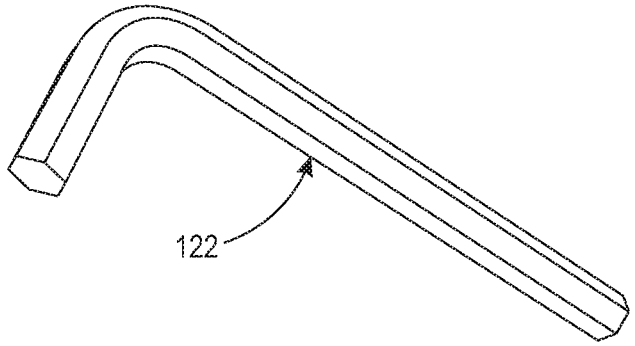
FIG. 6 is an exemplary removeable tool suitable for use in practicing exemplary embodiments of this disclosure.

Reference is now made to FIG. 6, which depicts an exemplary removeable tool 122 suitable for use in practicing exemplary embodiments of the present disclosure. As shown in FIG. 6, removeable tool 122 is an allen wrench. However, it should be appreciated that embodiments of removeably tool 122 include any type of tool that can be (1) removeably attached to one of the inside of the handgrip 104, buttstock 106, or stock 102, and (2) can removeably affix handgrip 104, buttstock 106, and forearm grip 108 to stock 102 through screws, nuts, bolts, clamps, clasps and the like. In the embodiment shown in FIG. 6, removeable tool 122 is operably sized to fit within cavity 120 of handgrip 104. Embodiments of removeable tool 122 include screwdrivers, wrenches, pliers, and driver sockets.

Figure 7:
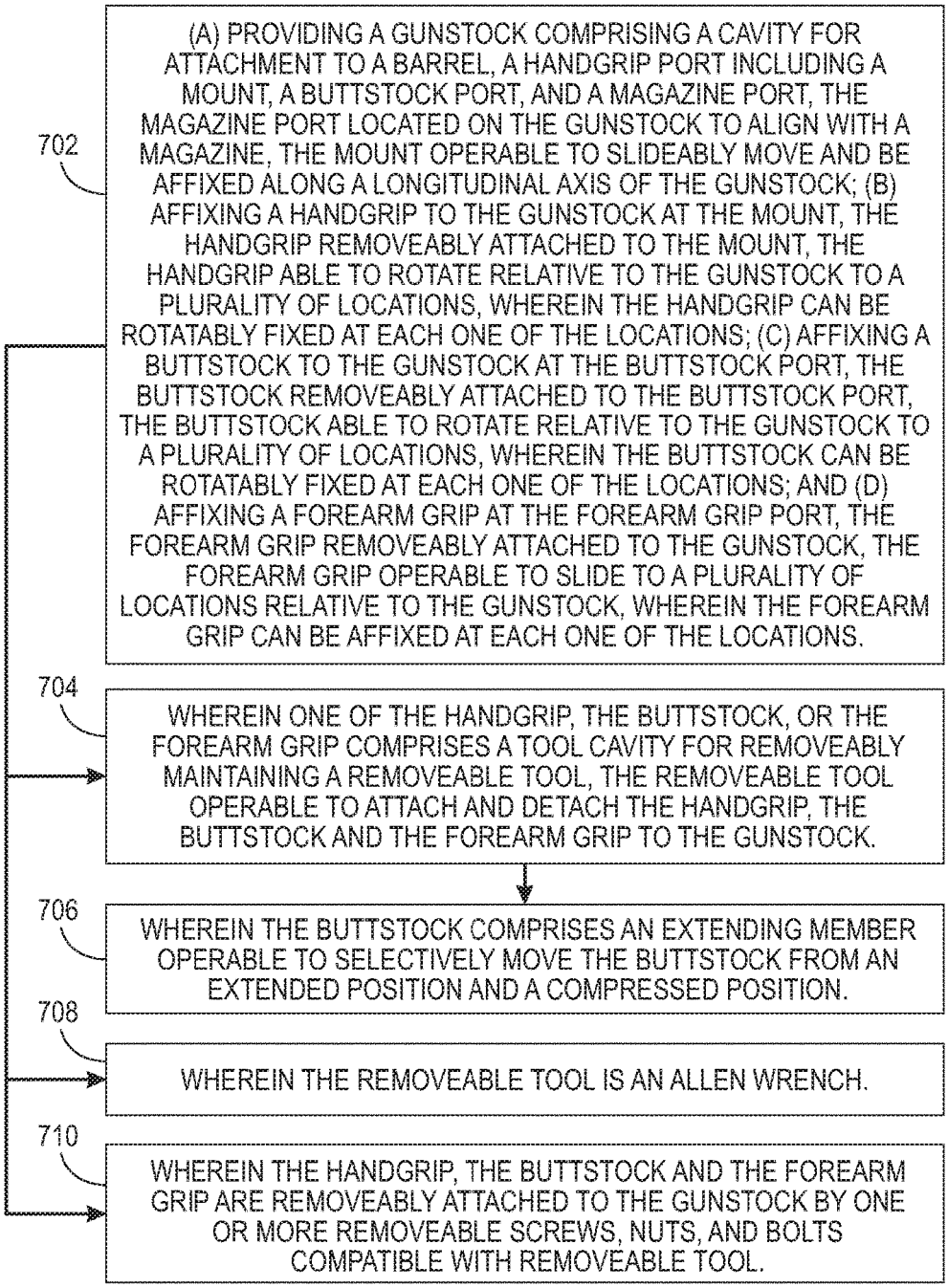
FIG. 7 is a logic flow diagram in accordance with a method and apparatus of the present disclosure.

Referring to FIG. 7, shown is a logic diagram in accordance with a method of the present disclosure. Block 702 relates to (a) providing a gunstock comprising a cavity for attachment to a barrel, a handgrip port including a mount, a buttstock port, and a magazine port, the magazine port located on the gunstock to align with a magazine, the mount operable to slideably move and be affixed along a longitudinal axis of the gunstock; (b) affixing a handgrip to the gunstock at the mount, the handgrip removeably attached to the mount, the handgrip able to rotate relative to the gunstock to a plurality of locations, wherein the handgrip can be rotatably fixed at each one of the locations; (c) affixing a buttstock to the gunstock at the buttstock port, the buttstock removeably attached to the buttstock port, the buttstock able to rotate relative to the gunstock to a plurality of locations, wherein the buttstock can be rotatably fixed at each one of the locations; and (d) affixing a forearm grip at the forearm grip port, the forearm grip removeably attached to the gunstock, the forearm grip operable to slide to a plurality of locations relative to the gunstock, wherein the forearm grip can be affixed at each one of the locations. Block 704 further relates to wherein one of the handgrip, the buttstock, or the forearm grip comprises a tool cavity for removeably maintaining a removeable tool, the removeable tool operable to attach and detach the handgrip, the buttstock and the forearm grip to the gunstock.

Following block 704, further non-limiting implementations begin at block 706. Block 706 includes wherein the removeable tool is an allen wrench. Then block 708 specifies wherein the buttstock comprises an extending member operable to selectively move the buttstock from an extended position and a compressed position. Block 710 then states wherein the handgrip, the buttstock and the forearm grip are removeably attached to the gunstock by one or more removeable screws, nuts, and bolts compatible with removeable tool.

The logic flow diagram of FIG. 7 may be considered to illustrate the operation of a method. The logic flow diagram of FIG. 7 may also be considered a specific manner in which components of the device are configured to cause that device to operate, whether such a device is an stock, gunstock, firearm, buttstock, handgrip, forearm grip, or one or more components thereof.

This disclosure has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A firearm attachment for adjustment, the firearm attachment comprising:

(a) a gunstock comprising a cavity for attachment to a barrel, a handgrip port including a mount, a buttstock port, and a magazine port, the magazine port located on the gunstock to align with a magazine, the mount operable to slideably move and be affixed along a longitudinal axis of the gunstock;

(b) a handgrip, the handgrip removeably attached to the mount, the handgrip able to rotate relative to the gunstock to a plurality of locations, wherein the handgrip can be rotatably fixed at each one of the plurality of locations;

(c) a buttstock, the buttstock removeably attached to the buttstock port, the buttstock able to rotate relative to the gunstock to a plurality of locations, wherein the buttstock can be rotatably fixed at each one of the locations; and (d) a forearm grip, the forearm grip removeably attached to the gunstock, the forearm grip operable to slide to a plurality of locations relative to the gunstock, wherein the forearm grip can be affixed at each one of the locations.

2. The firearm attachment according to claim 1, wherein one of the handgrip, the buttstock, or the forearm grip comprises a tool cavity for removeably maintaining a removeable tool, the removeable tool operable to attach and detach the handgrip, the buttstock and the forearm grip to the gunstock.

3. The firearm attachment according to claim 2, wherein the removeable tool is an allen wrench.

4. The firearm attachment according to claim 1, wherein the buttstock comprises an extending member operable to selectively move the buttstock from an extended position and a compressed position.

5. The firearm attachment according to claim 1, wherein the handgrip, the buttstock and the forearm grip are removeably attached to the gunstock by one or more removeable screws, nuts, and bolts compatible with removeable tool.

6. A method comprising:

(a) providing a gunstock comprising a cavity for attachment to a barrel, a handgrip port including a mount, a buttstock port, and a magazine port, the magazine port located on the gunstock to align with a magazine, the mount operable to slideably move and be affixed along a longitudinal axis of the gunstock;

(b) affixing a handgrip to the gunstock at the mount, the handgrip removeably attached to the mount, the handgrip able to rotate relative to the gunstock to a plurality of locations, wherein the handgrip can be rotatably fixed at each one of the plurality of locations;

(c) affixing a buttstock to the gunstock at the buttstock port, the buttstock removeably attached to the buttstock port, the buttstock able to rotate relative to the gunstock to a plurality of locations, wherein the buttstock can be rotatably fixed at each one of the locations; and (d) affixing a forearm grip at the forearm grip port, the forearm grip removeably attached to the gunstock, the forearm grip operable to slide to a plurality of locations relative to the gunstock, wherein the forearm grip can be affixed at each one of the locations.

7. The method according to claim 6, wherein one of the handgrip, the buttstock, or the forearm grip comprises a tool cavity for removeably maintaining a removeable tool, the removeable tool operable to attach and detach the handgrip, the buttstock and the forearm grip to the gunstock.

8. The method according to claim 7, wherein the removeable tool is an allen wrench.

9. The method according to claim 6, wherein the buttstock comprises an extending member operable to selectively move the buttstock from an extended position and a compressed position.

10. The method according to claim 6, wherein the handgrip, the buttstock and the forearm grip are removeably attached to the gunstock by one or more removeable screws, nuts, and bolts compatible with removeable tool.

11. An apparatus for attachment, the apparatus comprising:

(a) a gunstock comprising a cavity for maintaining a receiver, the gunstock including a mount slideably moveable along the longitudinal axis of the gunstock to a plurality of locations, the mount operable to affix to the gunstock at each one of the plurality of locations; and (b) a handgrip removeably attached to the mount, the handgrip rotatably moveable about the gunstock to a plurality of angles, the handgrip operable to be affixed at each one of the plurality of angles, wherein one of the handgrip comprises a tool cavity and a removeable tool, the tool cavity for removeably maintaining the removeable tool, the removeable tool operable for attaching and adjusting a location of the handgrip relative to the gunstock.

12. The apparatus according to claim 11, wherein the removeable tool is one of an allen wrench, a screwdriver, or a wrench.

13. The apparatus according to claim 11, wherein the handgrip is removeably attached to the gunstock by one or more removeable screws, nuts, and bolts operable with the removeable tool.

14. The apparatus according to claim 11, the apparatus further comprising a buttstock removeably attached to the gunstock, the buttstock operable to rotatably affix to a plurality of locations relative to the gunstock.

15. The apparatus according to claim 11, wherein the handgrip is slideably affixed to the gunstock by rails.

* * * * *